United States Patent [19]

Campbell et al.

[11] 4,212,404

[45] Jul. 15, 1980

[54] DEVICE FOR LIFTING CRANE BOOM

[75] Inventors: George T. R. Campbell, Nassau, The Bahamas; Yukitoshi Morioke, Chiba, Japan

[73] Assignee: Algoship International Limited, Nassau, The Bahamas

[21] Appl. No.: 864,481

[22] Filed: Dec. 27, 1977

[30] Foreign Application Priority Data

Dec. 25, 1976 [JP] Japan ..... 51-157131

[51] Int. Cl.[2] ..... B66C 23/54

[52] U.S. Cl. ..... 212/238; 212/232; 414/694

[58] Field of Search ..... 212/8 R, 9, 33, 56–60, 212/64; 414/680, 694, 715; 254/139.1

[56] References Cited

U.S. PATENT DOCUMENTS

| | | | |
|---|---|---|---|
| 3,073,397 | 1/1963 | Balogh | 212/8 R X |
| 3,517,829 | 6/1970 | Tax | 212/59 R |
| 3,608,742 | 9/1971 | Adolfsson | 212/58 R X |

FOREIGN PATENT DOCUMENTS

| | | | |
|---|---|---|---|
| 221750 | 6/1972 | Austria | 212/33 |
| 105769 | 1/1965 | Norway | 212/59 R |

*Primary Examiner*—Stephen G. Kunin
*Assistant Examiner*—Terrance L. Siemens
*Attorney, Agent, or Firm*—Larson, Taylor and Hinds

[57] ABSTRACT

A boom lifting system for a crane of the type having an upright mast and a boom hinged to the mast. The system has a brace extending between the mast and the boom. The brace is pivotally connected to both the mast and the boom and has a hinge dividing it into a short section, connected to the boom, and a long section, connected to the mast. A hydraulic cylinder is pivotally connected to both the boom and the short brace section. Actuation of the cylinder straightens or bends the brace to respectively lift or lower the boom relative to the mast.

12 Claims, 5 Drawing Figures

DEVICE FOR LIFTING CRANE BOOM

This invention is directed toward an improved lifting system for cranes, particularly cranes of the type having an upright mast and a boom hinged at one end to the mast.

Cranes of the above type are commonly employed on ships to load and unload cargo. Various lifting systems are employed to raise or lower the boom about its hinge relative to the mast, between a working and storage position. One system employs a hydraulic cylinder pivotally connected between the post and boom at points spaced some distance from where the boom is hinged to the mast. The cylinder acts as a brace, as well as raising or lowering the boom. However, the cylinder must be overly strong, and thus expensive, to prevent buckling while acting as a brace. In addition, the cylinder must have a long stroke, and thus a long piston rod, to raise the boom thus increasing the danger of buckling of the rod. Also, the cylinder is mounted in a position where it can be damaged by swinging cargo being loaded or unloaded.

Another type of lifting system employs a rigid brace pivotally connected between the boom and a block slidable along the mast. A hydraulic cylinder is mounted along the mast to raise or lower the block and thus raise or lower the boom. While the cylinder is better protected from accidental damage in this system than in the previous system, and does not have to act as a brace, it still must have a long stroke to be able to vertically move the boom. The sliding block, and a guide for it, add additional expense to the system. Also, the arrangement requires the use of a very long brace, if the boom is to be properly raised or lowered.

A third known lifting system employs a hinged brace pivotally connected between the boom and the mast at a point spaced from the hinge joining the mast and boom. A hydraulic cylinder is pivotally connected between the hinge joining the mast and boom, and the hinge in the brace. This system is simple and eliminates the need for the cylinder to act as a brace. However, the cylinder stroke still must be long and even then the range of movement of the boom is limited. Also, the piston rod of the cylinder is extended when the boom is stored and thus is subjected to corrosion, and, the cylinder is still mounted in a position where it could be damaged by the cargo being handled.

In accordance with the present invention there is provided a boom lifting system for a crane which is simple in construction and relatively inexpensive. The hydraulic cylinder employed to raise or lower the boom can be smaller in size than the cylinders used in other systems due to the novel arrangement of the lifting system. In addition, the cylinder does not require a long stroke and thus is less susceptible to buckling. Even though a short stroke is used, the arrangement still permits the boom to be moved through a relatively large angle. Further, the cylinder is mounted in a position where it is unlikely to be damaged by swinging cargo. Also, the piston rod is retracted into the cylinder when the boom is stored, thus minimizing corrosive effects. The present invention also provides an extremely stable, yet quick acting lifting system.

In accordance with the present invention there is provided a boom lifting system for a crane of the type having a mast and a boom hinged to the mast. The system has a brace extending between the mast and the boom. The brace is pivotally connected to both the mast and the boom and has a hinge dividing the brace into a short section connected to the boom and a long section connected to the mast. Boom moving means are connected to both the boom and the short brace section, actuation of the moving means raising or lowering the boom relative to the mast.

The invention will now be described in detail having reference to the accompanying drawings in which.

Figure 1:
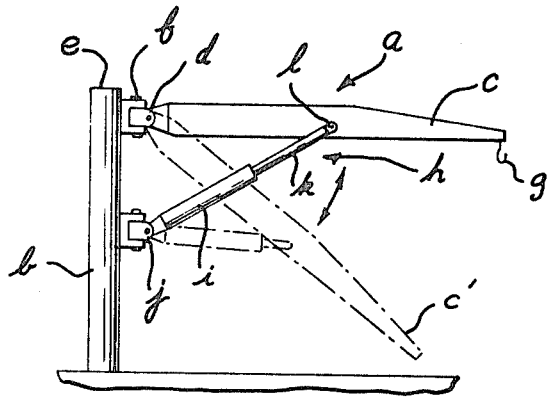
Fig-1 PRIOR ART
FIGS. 1, 2 and 3 are schematic views of prior art lifting systems for cranes.
Figure 2:
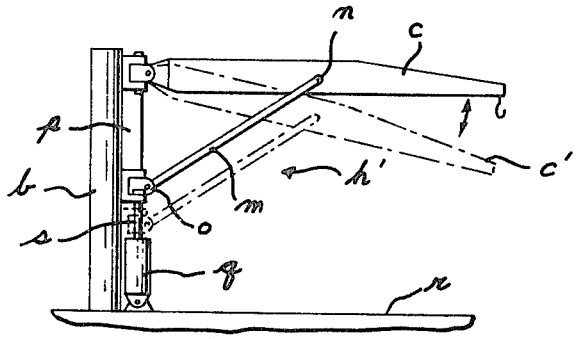
Fig-2 PRIOR ART
Figure 3:
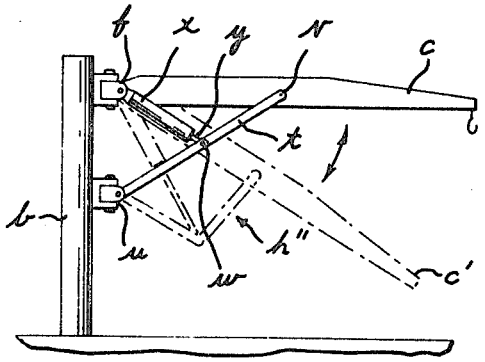
Fig-3 PRIOR ART

With reference to FIGS. 1 to 3, cranes "a", of the type having a vertical post or mast "b" and a lifting boom "c" are well known. The boom "c" is connected at one end "d" to the mast "b" at or near its top end "e" by a double pivot connection "f". Connection "f" allows the boom "c" to pivot up or down about connection "f", and also to swing about mast "b". The boom "c" carried a hook "g" for supporting a load which hook can travel along the length of the boom "c" and which can be raised or lowered.

Various boom lifting systems "h" have been employed on cranes "a". One such lifting system "h" employs a hydraulic cylinder "i", as shown in FIG. 1, as a combined brace and lifter. The cylinder "i" is connected at one end to the mast "b", at a point some distance below pivot connection "f", by another pivot connection "j". The free end of the piston rod "k", projecting from cylinder "i" is connected by a further pivot connection "l" to boom "c" intermediate its ends. In operation, extension of piston rod "k" raises the boom "c" about pivot connection "f" to a horizontal working position. The cylinder "i" braces the boom in this position. Retraction of piston rod "k" lowers boom "b" to its stored position (shown by dotted lines "$c^1$").

Another lifting system "h" shown in FIG. 2, employs a diagonal rigid brace "m". The brace "m" is connected at one end by a pivot connection "n" to boom "c" intermediate the ends of the boom. The other end of the brace "m" is connected by a pivot connection "o" slidably fastened to mast "b" intermediate the length of the mast. Pivot connection "o" is of the type which allows brace "m" to pivot up and down and also to swing about mast "b". The pivot connection "o" is slidably mounted on a vertical slide "p" fixed to mast "b". A hydraulic cylinder "q" is located adjacent mast "b" with its lower end fixed to the base "r" or to the mast "b". The free end of its piston rod "k" is fixed to slidable pivot connection "o". In operation, extension of piston rod "s" by cylinder "q" raises pivot connection "o" along slide "p". This in turn raises rigid brace "m" and pivots boom "c" up from its lowered, stored position (shown in dotted lines "$c^1$") to its horizontal working position.

A further lifting system "$h^{11}$" is shown in FIG. 3. Here, a two piece hinged brace "t" is used to support boom "c". The brace "t" is connected at one end to mast "b", intermediate the mast ends, by a pivot connection "u". Pivot connection "u" allows the brace "t" to move up or down and also to swing about mast "b". The other end of brace "t" is connected to boom "c" intermediate its ends, with a pivot connection "v". A hinge "w" connects the two adjacent ends of the brace "t". The brace "t" folds at this hinge "w" in a plane aligned with the brace, boom and mast. A hydraulic cylinder "x" is pivotally connected at one end to the pivot connection "f" joining mast "b" and boom "c". The free end of its piston rod "y" is pivotally connected to the brace "t" at hinge "w". In operation, retraction of piston rod "y" by cylinder "x" straightens folded brace "t". As the brace "t" is straightened, boom "c" is lifted about pivot connection "f" from its inclined, stored position "c1" to its horizontal, working position.

Figure 4:
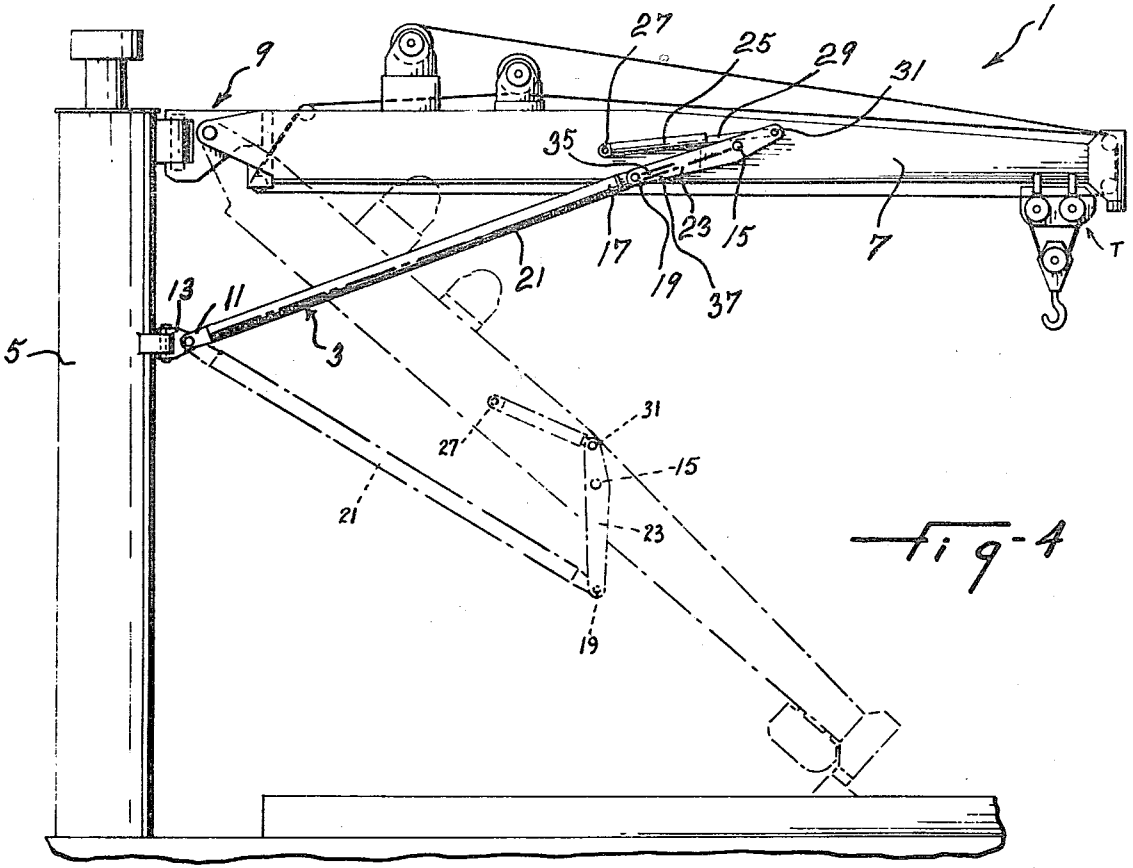
FIG. 4 is an elevation view of a crane employing the lifting system to the present invention.

As previously discussed, all the lifting systems described above have disadvantages. Applicant's lifting system shown in FIG. 4 is designed to overcome the disadvantages of the prior art systems. The improved lifting system 1, shown in FIG. 4, has a hinged brace 3 pivotally connected between the vertical mast 5 and boom 7. The boom 7 is connected at one end by a double pivot connection 9 to the mast 5 at or near its top end. The pivot connection 9 allows the boom 7 to pivot up and down and also to swing about mast 5.

The brace 3 is pivotally connected at one end 11 to mast 5 by a pivot connection 13 which allows the brace 3 to move up or down and also to swing about mast 5. The pivot connection 13 is fixed to mast 5 some distance below pivot connection 9. The brace 3 is also pivotally connected to the side of boom 7 by a pivot pin 15. Pin 15 is located on boom 7 intermediate its ends and is also spaced a short distance from the other end 17 of brace 3.

The brace 3 is hinged with a hinge 19 located between pivot connection 13 and pin 15. Hinge 19 preferably is close to pin 15 dividing the brace 3 into a long section 21, connected to mast 5, and a short section 23 connected to boom 7. Hinge 19 allows the brace to fold down in a plane generally parallel to the plane containing mast 5 and boom 7 at any slewed position of the boom within an arc of approximately 180°.

Boom moving means, preferably in the form of a relatively small hydraulic cylinder 25, is mounted on the side of boom 7. One end of the cylinder 25 is pivotally mounted on boom 7 by a pivot pin 27. Pivot pin 27 preferably is located between brace pivot pin 15 and pivot connection 9 so that cylinder 25 extends inwardly toward mast 5. The piston rod 29 of cylinder 25 is connected by a pivot pin 31 to the extension 23 of brace 3 located on the other side of pin 15 from hinge 19.

In operation, when piston rod 29 is retracted by cylinder 25, the brace 3 is folded down about its hinge 19 and boom 7 is stored in an inclined position. To raise boom 7 to an operative, generally horizontal position, cylinder 25 is actuated to extend piston rod 29. As piston rod 29 is extended, it rotates brace section 23 about pivot pin 15. This rotative movement, straightens out brace 3 and thus raises boom 7. The rotation of section 23 continues until brace 3 has straightened and then been bent slightly in the opposite direction. At this point piston rod 29 is fully extended, being in fact, pulled out by the weight of the boom. The boom is locked in its working position by moving the axis of hinge 19 in brace 3 a slight distance 35 past a line 37 joining pivot connection 13 and pivot pin 15. It will be understood that as hinge 19 moves up past imaginery line 37, boom 7 reaches its maximum height and then drops slightly.

To store the boom 7, the piston rod 29 is retracted, rotating short brace section 23 about pin 15 and moving hinge 19 down, past imaginery line 37, to fold brace 3. When hinge 19 moves past line 37, the weight of the boom 7 will assist in retracting piston rod 29. When the rod is fully retracted, the boom is stored in its inclined position.

Figure 5:
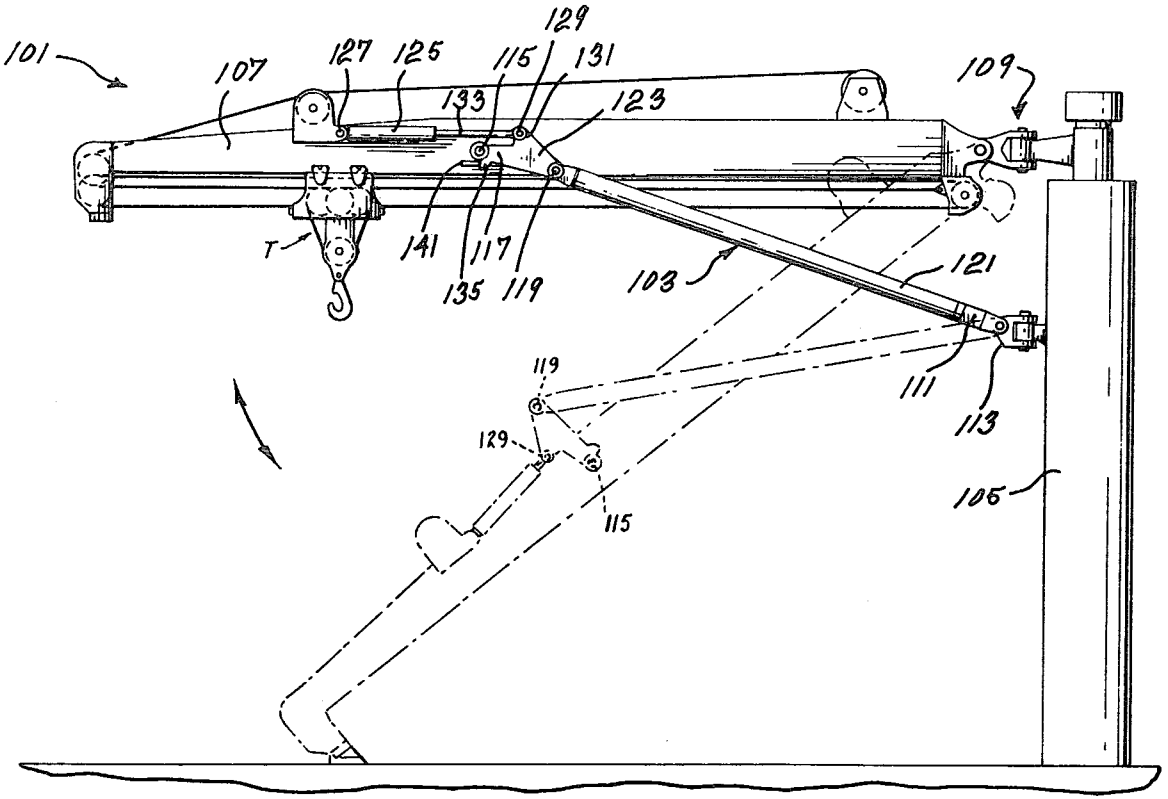
FIG. 5 is an elevation view of a crane employing a modified lifting system, similar to that shown in FIG. 4, of the present invention.

A slightly modified form of the lifting system 1 is shown in FIG. 5. This modified lifting system 101 also employs a hinged brace 103 connected between a vertical mast 105 and a boom 107. The boom 107 is again connected at one end by a double pivot 109 to the mast 105 at or near its top end, the pivot connection 109 allowing the boom to swing up or down and also about mast 105. The brace 103 is connected at one end 111 by a double pivot 113 to mast 105 at a point spaced some distance below pivot 109. Double pivot 113 also allows brace 103 to move up and down relative to mast 105 and to swing about the mast. Brace 103 is also pivotally connected to the side of boom 107 by a pivot pin 115.

The construction described so far is the same as that shown in FIG. 4. In this embodiment however, the pivot pin 115 is located at the end 117 of brace 103. The brace 103 is hinged with a pivot pin 119 located between its ends 111, 117. Pivot pin 119 is located substantially closer to end 117 than to end 111 and divides brace 103 into a long section 121 connected to mast 105 and a short section 123 connected to boom 107. The pin 119, like pin 19, also allows brace 103 to fold or hinge in a plane containing both the boom and the mast. Boom moving means, in the form of a relatively small hydraulic cylinder 125, is mounted along the side of boom 107. The cylinder 125 in this embodiment is located in the same plane as brace 103 along boom 107 and is connected at its outward end to boom 107 by a pivot pin 127. Brace section 123 has a lateral projection 131 generally midway between its connection to pins 115, 119. The projection 131 extends upwardly from brace section 123 and piston rod 133 of cylinder 125 is connected to this projection by pin 129. The brace section 123 can also have a projecting stop 135 adjacent pivot pin 115.

In operation, when the piston rod 133 is retracted, the brace 103 is hinged about pin 119 with short section 123 pivoted about pin 115 to raise hinge pin 119 and lower boom 107 to its inclined position in which it is stored.

When cylinder 125 is actuated, the piston rod 133 swings section 123 about pin 115 straightening out brace 103 and thus raising boom 107 about pivot 109 relative to mast 105. Preferably, the cylinder 125 is actuated until pivot pin 119 has just passed a dead center line joining the axis of pin 115 and the horizontal axis of pivot 113. At this point, boom 107 is generally horizontal and brace 103 is "locked" with stop 135 contacting abutment 141 on boom 107 to limit further movement by cylinder 125.

The cylinders 25 and 125 generally remain along the side of the boom at all times with piston rods 29 and 133 either extended or retracted and thus are protected from possible damage by the load carried by the boom. In addition, the piston rods 29 and 133 are in the retracted position protecting them from corrosion when the boom is stored and not in use. The hydraulic cylinders 25, 125 are relatively small, compared to prior art cylinders. Since the brace 3, 103 are divided into a relatively short section and a relatively long section; and since the cylinders are connected to the short section, only a relatively short piston stroke is required to fold or unfold braces 3, 103 and thus raise or lower boom 7, 107. The shorter stroke minimizes the possibility of buckling the piston rod. However, even though a short stroke cylinder is used, the arrangement provided permits the boom to be moved through a relatively large angle.

The lifting system also provides some flexibility in selecting the size of hydraulic cylinders 25, 125 since the length of the short brace sections 23, 123 and the distance pivots 15 and 31, and pivots 115 and 129 can be varied.

The embodiments of the invention in which an exclusive property or privilege is claimed are defined as follows:

1. A lifting system for a crane of the type having a mast, and a boom hinged to the mast; the lifting system having a brace, extending between the mast and the boom; the brace pivotally connected to both the mast and the boom; a hinge in the brace dividing it into a short section, connected to the boom, and a long section, connected to the mast; and boom moving means pivotally connected to the boom and the short brace section at a first point spaced from the hinge.

2. A lifting system as claimed in claim 1 wherein the short brace section is pivotally connected to the boom at a second point spaced from the hinge, the second point located between the hinge and the first point.

3. A lifting system as claimed in claim 2 wherein the moving means is pivotally connected to the boom between the mast and the first point.

4. A lifting system as claimed in claim 3 wherein the moving means is constructed to move the brace from a first folded position with the boom lowered, through a straightened position to a second, slightly-folded position in the opposite direction with the boom raised.

5. A lifting system as claimed in claim 4 wherein the moving means comprises a hydraulic cylinder having a piston rod which is fully extended when the brace is in the second position.

6. A lifting system as claimed in claim 5 wherein the cylinder is positioned alongside the boom.

7. A lifting system as claimed in claim 1 wherein the short brace section is pivotally connected to the boom at a second point spaced from the hinge, the first point located between the second point and the hinge.

8. A lifting system as claimed in claim 7 wherein the moving means is pivotally connected to the boom between the free end of the boom and the said second point.

9. A lifting system as claimed in claim 8 wherein the moving means is constructed to move the brace from a first folded position with the boom lowered, through a straightened position to a second, slightly-folded position in the opposite direction with the boom raised.

10. A lifting system as claimed in claim 9 wherein the moving means comprises a hydraulic cylinder having a piston rod which is fully extended when the brace is in the second position.

11. A lifting system as claimed in claim 10 wherein the cylinder is positioned alongside the boom.

12. A lifting system as claimed in claim 7 wherein said first point is offset transversely from a line joining the hinge and the second point.

* * * * *